US005874690A

United States Patent [19]

Brunn

[11] Patent Number: 5,874,690

[45] Date of Patent: Feb. 23, 1999

[54] SMOKE GRENADE WITH RAPID IGNITION

[76] Inventor: Michael Brunn, 226 New Town Rd., Plainview, N.Y. 11803

[21] Appl. No.: 19,860

[22] Filed: Feb. 6, 1998

[51] Int. Cl.[6] ..... F42B 12/48

[52] U.S. Cl. ..... 102/334

[58] Field of Search ..... 102/334

[56] References Cited

U.S. PATENT DOCUMENTS

| | | | |
|---|---|---|---|
| 3,120,183 | 2/1964 | Wheelwright et al. | 102/334 |
| 3,238,143 | 3/1966 | Ainsley et al. | 102/334 |
| 3,911,823 | 10/1975 | Murray et al. | 102/334 X |
| 4,291,629 | 9/1981 | Keter | 102/334 |
| 4,624,186 | 11/1986 | Widera et al. | 102/334 X |
| 5,313,888 | 5/1994 | Martin | 102/334 |

*Primary Examiner*—Peter A. Nelson
*Attorney, Agent, or Firm*—Myron Amer P.C.

[57] ABSTRACT

A smoke grenade including in an interposed position between a fuse emitting a low intensity flame and a smoke-generating composition requiring for optimum smoke production ignition by a high intensity flame, a rocket motor propellant which is ignited by the fuse and thereupon generates the high intensity flame resulting in smoke-generating service of the composition in an optimum short duration which foils manual removal of the grenade from the intended site of use.

1 Claim, 1 Drawing Sheet

SMOKE GRENADE WITH RAPID IGNITION

Figure 1:
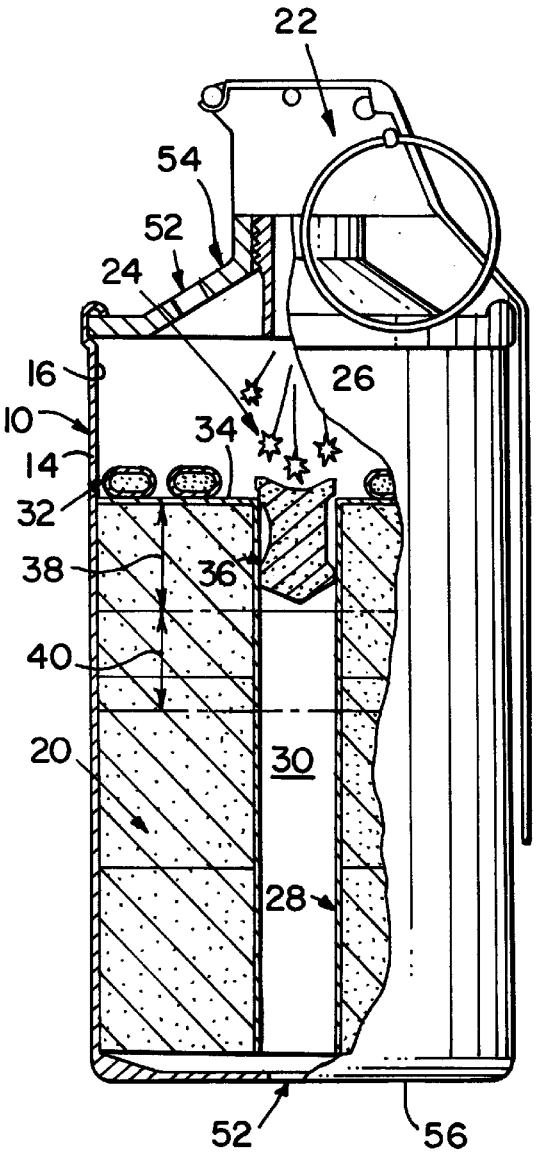
FIG.1 PRIOR ART

The present invention relates generally to improvements for a smoke grenade, the improvements more particularly contributing to rapid ignition of the polytechnic thereof, typically within 0.5 to 1.5 seconds, with the consequence of a rapidly-achieved full smoke output which, among other advantages, obviates the frequently used neutralizing technique of a smoke grenade delivered to disperse a crowd having an individual of the crowd picking up the grenade and throwing the grenade to another location.

EXAMPLES OF THE PRIOR ART

Smoke grenades are well known devices used for military objectives, as described and illustrated for example in U.S. Pat. No. 3,726,226 for "Universal Smoke Making Grenade For Dry And Inundated Areas" issued to Andrew J. Grandy on Apr. 10, 1973, in U.S. Pat. No. 3,372,641 for "Pressure Retention Chamber For Smoke Grenade" issued to J. E. Foster on Mar. 12, 1968, and in U.S. Pat. No. 4,353,301 for "Smoke Grenade" issued to Kjell 0. Jacobsen on Oct. 12, 1982.

Singling out the smoke grenade of the '301 patent as typical of the noted "military" smoke grenades, the '301 grenade operating mode or ignition sequence contemplates: that a primer composition 4 in the discharge 3 is ignited; and when a booster delay 7, ignited by the primer composition 4 "burns through", an ignition/bursting charge 8 is ignited; and lastly when a booster with a short delay 11, ignited by the ignition/bursting charge 8 "burns through", another so-called primer charge 12 is ignited to in turn ignite the HC composition 14 resulting in smoke generation.

By common experience it is also known that a smoke grenade has a significant non-military use, such as, for example, dispersing an unruly crowd. In this exemplary use, it is not uncommon for the delivered smoke grenade to be picked up by an individual in the crown and thrown elsewhere, thus neutralizing the effective use of the smoke grenade. In the use of the previously noted "military" smoke grenades, the time duration to achieve full ignition and consequently full smoke output of the grenade is typically too long to obviate the above noted neutralizing technique.

Broadly, it is an object of the present invention to provide a smoke grenade with a rapid ignition overcoming the foregoing and other shortcomings of the prior art.

More particularly, it is an object to embody a rocket motor propellant, heretofore exclusively having a flight-producing utility, as an ignition component in the ignition sequence of a smoke grenade, all to the end of obviating the likelihood of a neutralizing of the smoke grenade and achieving other benefits, as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
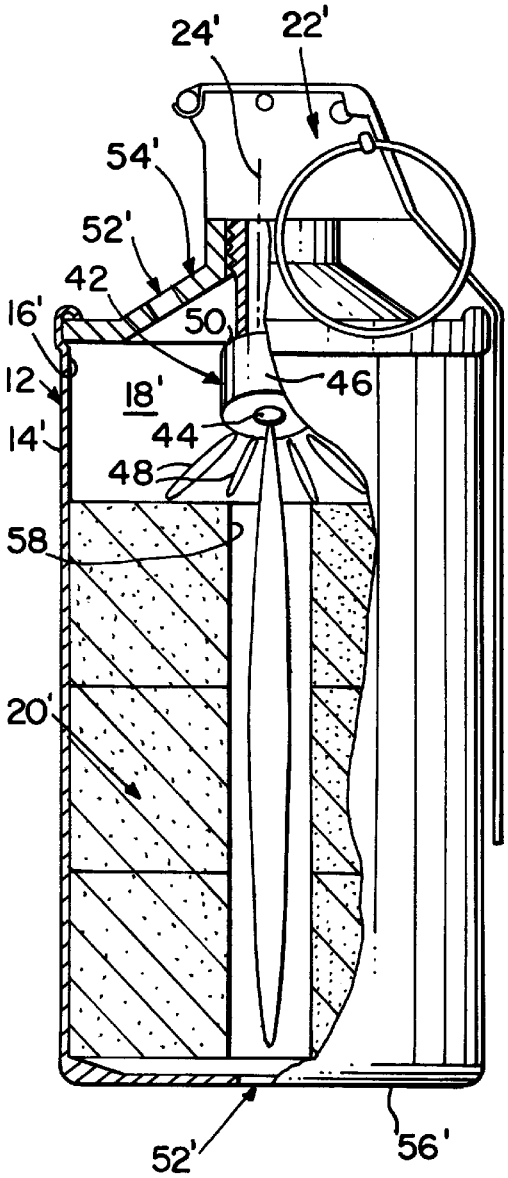

FIG. 1 is a longitudinal cross sectional view of a prior art smoke grenade; and FIG. 2 similarly is a longitudinal cross sectional view, but of the within inventive smoke grenade.

Shown in FIG. 1 is a prior art smoke-emitting grenade 10 now to be described for subsequent comparison with the within inventive smoke-emitting grenade 12 of FIG. 2, wherein the differences to be noted therebetween will enhance a better understanding of the patentable advance of grenade 12. Grenade 10 has a cylindrical body 14, the inner surface 16 of which bounds a compartment 18 for a conically shaped configuration of known, commercially available, pyrotechnic smoke composition pellets, individually and collectively designated 20, with a known operating mode of producing smoke as a product of combustion upon being ignited by a fuse 22, also of a commercially available construction and operating mode of producing a downwardly directed output of flame 24 and hot slag 26. Because the relatively high ignition temperature of the composition pellets 20 is not always achieved with the fuse output 24, 26, it is common practice to apply a combustible starter coating 28 on the grenade central core 30, position combustible ignition granules 32 on the upper surface 34 of the conical shape 20, and use additional combustible granules in a bag 36 seated in the upper opening in the core 30. While the noted combustion aids assist in the ignition of the smoke composition pellets 20 by raising, what can aptly be characterized as a low intensity flame of the fuse 22 to a higher intensity, the burning of the composition pellets 20 is undesirably progressive, rather than instantaneous, in that initial combustion is in an upper section 38 which, when ignited, ignites a succeeding section 30 which, also when ignited, ignites a next adjacent section 40, and so on, with the result that there is a time duration during which there is a series of partial smoke-emitting outputs of the prior art smoke composition pellets 20. Among other shortcomings of this time-consumed operating mode is that the grenade 10 thrown or otherwise used to dispense a crowd can be picked up by an individual in the crowd and thrown elsewhere. This neutralizing of a smoke grenade is significantly less likely if burning of its smoke composition pellets is rapid or instantaneous, and its smoke output correspondingly full when delivered to the site of the crowd being disbursed.

A preferred operating mode of a smoke grenade is one in which complete smoke emission occurs in about 0.5 to 1.5 seconds; this operating mode being achieved by the FIG. 2 grenade 12 using a commercially available, and known construction and operating mode of a rocket motor propellant 42 which, responding to a fuse-produced flame 24' as an ignition source applied to a through bore 44 of its conical shape body 46 ignites and burns radially from the inside out producing a downwardly directed high intensity jet of flame 48 and hot gasses for the noted duration of about 0.5 to 1.5 seconds. Embodied with some of the same structural features already described in connection with the grenade of FIG. 1 which, for brevity's sake will not be repeated, and are designated by the same but primed reference numerals, grenade 12 includes the noted rocket motor propellant 42 which is adhesively or otherwise appropriately secured, as at 50, in the clearance or upper area of the compartment 18' in the path of the flame output 24' of the fuse 22', i.e. in an interposed operative position in a superposed arrangement between the fuse 22' and the smoke-generating or smoke composition pellets 20'.

In comparing the prior art grenade 10 to the within inventive grenade 12, in the former the method of ignition of the pyrotechnic composition 20 is not as rapid and accordingly is not as rapid in achieving full smoke emission and thus smoke output takes longer than that of the latter grenade 12. Additionally temporarily sealed emission ports 52 in the top 54 and bottom 56 of grenade 10 do not burst immediately since pressure has to build up in the grenade 10 as a result of, using the parlance of the trade, the pyrotechnic payload 20 thereof "ramping up to full burn". In the grenade

12 however, fuse output 24' ignites the center 44 of the rocket motor propellant 42 which proceeds to burn from the inside out, generating a high intensity flame 48 which engulfs the compartment interior 18' and ignites, as at 56 and 58, the pyrotechnic composition 20', the burning of which, along with smoke, produces hot gasses which burst the grenade vent ports 52', a condition in its operating mode which typically occurs in burn times ranging between 0.5 to 1.5 seconds. To those versed in the use of rocket motor propellant or so-called grain, it is known that grain burn time can be adjusted by controlling various characteristics such as type of material used, density, and like attributes. In the use in a grenade ignition method, rather than in powering a rocket, airplane or the like in flight, there is produced a very reliable and rapid ignition of the pyrotechnic payload 20' without additional ignition aids, such as starting coating 28, and isolated and bagged ignition granules 32, 36, all of which, and without such aids, contributes to an end result of a smoke grenade 12 that produces full output sooner after initiation.

While the smoke-emitting grenade herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Ignition improvements for a smoke-emitting grenade of a type having a fuse emitting a downwardly directed low intensity flame and a high intensity flame-ignitable smoke-generating composition in a clearance position removed from said fuse, said ignition improvements comprising a known rocket motor propellant of a known operating mode of producing a downwardly directed high intensity flame, and an interposed operative superposed arrangement of said rocket motor propellant in said clearance between said fuse and said smoke-generating composition, whereby said fuse-emitted low intensity flame is effective to ignite said rocket motor propellant and said emitted high intensity flame of said rocket motor propellant is effective to ignite said smoke-generating composition.

* * * * *